United States Patent [19]

Appling

[11] 4,408,419

[45] Oct. 11, 1983

[54] APPARATUS AND METHOD FOR SANDBLASTING FLANGED BEAMS

[76] Inventor: Tom J. Appling, 5706 Shoalwood St., Austin, Tex. 78756

[21] Appl. No.: 212,509

[22] Filed: Dec. 3, 1980

[51] Int. Cl.[3] ..... B24C 3/06; B24B 1/00

[52] U.S. Cl. ..... 51/429; 51/281 R; 51/241 S; 51/319; 105/153

[58] Field of Search ..... 51/428, 429, 241 S, 51/241 LG, 431, 281 R, 319; 104/245, 247, 243, 95; 105/153

[56] References Cited

U.S. PATENT DOCUMENTS

| | | | |
|---|---|---|---|
| 2,306,885 | 12/1942 | Klemm et al. | 105/153 |
| 2,642,958 | 6/1953 | Lennon | 105/153 |
| 2,729,918 | 1/1956 | Denburgh | 51/429 |
| 2,974,609 | 3/1961 | Bent et al. | 105/153 |
| 3,182,425 | 5/1965 | Goss et al. | 51/319 |
| 3,563,179 | 2/1971 | Gorjanc | 105/153 |
| 3,566,543 | 3/1971 | Fogle | 51/425 |
| 3,581,441 | 6/1971 | Hulbert, Jr. | 51/411 |
| 3,788,010 | 1/1974 | Goff | 51/429 |
| 3,827,187 | 8/1974 | Yamamoto et al. | 51/429 |
| 3,872,625 | 3/1975 | Fuma et al. | 51/425 |
| 4,064,656 | 12/1977 | Zeidler | 51/431 |
| 4,199,905 | 4/1980 | Neidigh et al. | 51/429 |
| 4,210,098 | 7/1980 | Harrison et al. | 51/429 |
| 4,248,157 | 2/1981 | Evans | 104/95 |
| 4,286,417 | 9/1981 | Shelton | 51/429 |

*Primary Examiner*—Roscoe V. Parker
*Attorney, Agent, or Firm*—Thomas S. Keaty

[57] ABSTRACT

Apparatus and method is disclosed for abrasively cleaning flanged beams having at least a web and an attached flange. The apparatus includes a carriage mountable on the underside of the flange of the beam to be cleaned, at least one powered wheel rotatably mounted on the underside of the beam flange and articulated structure for varying the angle of attack of a sandblasting nozzle whereby all surfaces of the beam may be sandblasted.

9 Claims, 7 Drawing Figures

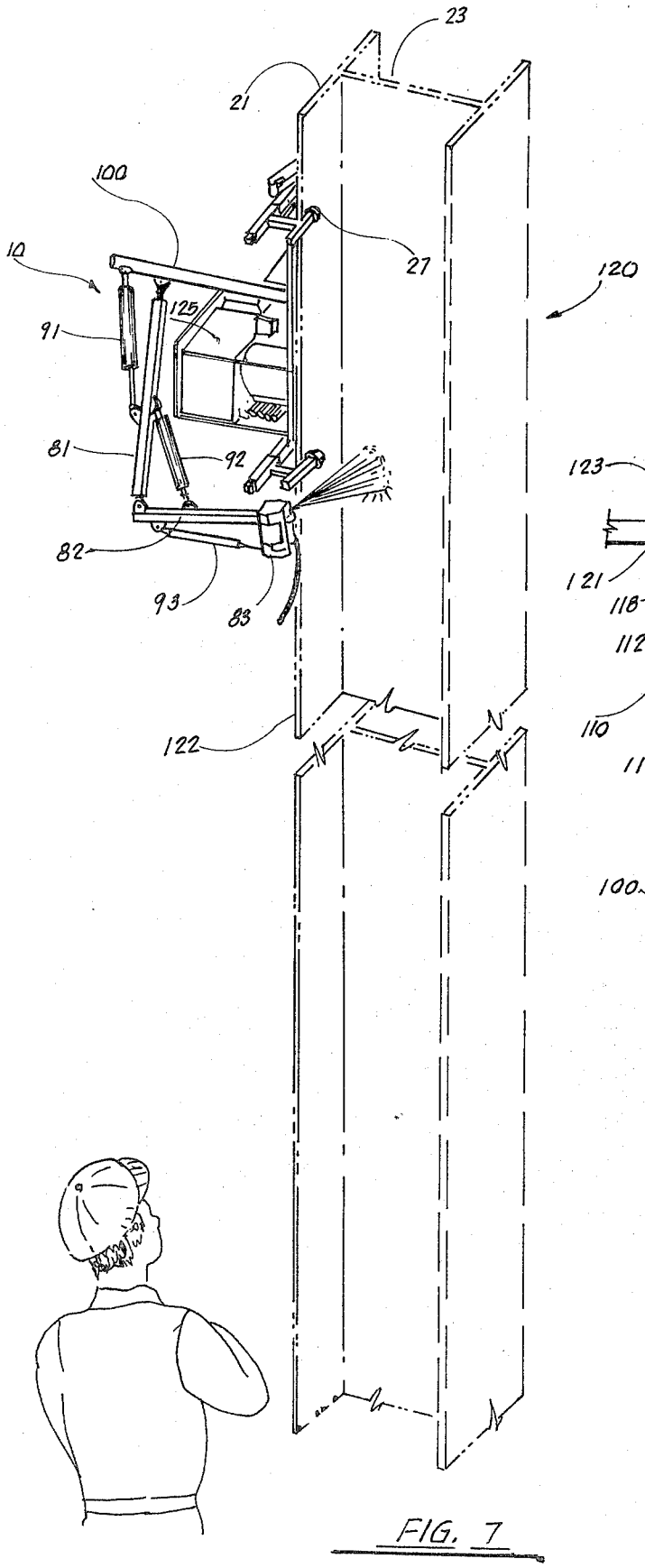
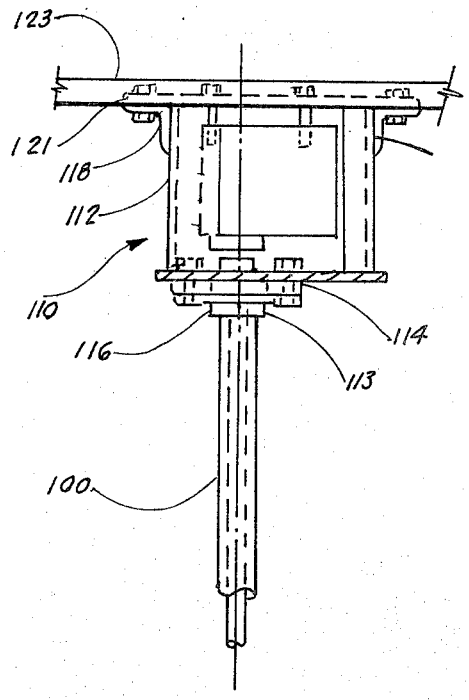
FIG. 5
FIG. 7

APPARATUS AND METHOD FOR SANDBLASTING FLANGED BEAMS

BACKGROUND OF THE INVENTION

The present invention relates to sandblasting and sandblasting devices. More particularly, the present invention relates to an apparatus which can be utilized for sandblasting of flanged beams by attaching the apparatus to the flanged beam and remotely controlling the movement of the apparatus and the movement of the sandblasting portion.

It is known in the field of sandblasting to use blasted sand in the abrasive cleaning of corrosion and rust which forms on bridges, especially beams, for example, and like structures and structural steel members. Such blasting is oftentimes an extremely dangerous task for the workers when done manually since elevation is sometimes great, creating a risk of injury by falling. Also, in addition to the danger involved, the beams to be sandblasted are oftentimes located in an area virtually inaccessible to the workers in order to position the sandblasting apparatus. In the present state of the art, sandblasting with compressed air is being replaced by high pressure water sandblasting, in order to provide for safer environmental protection. The pressure forces which are developed by the nozzles of the water blasts can be high, such as for example, 10,000 PSI, with air sandblasting being at lower pressures (eg 115 PSI). The use of human-operated water sandblasters creates the additional hazard of slippery scaffolding, and therefore, the risk of serious injuries to the operator.

Several patents show portable devices allegedly useful for abrasive removal of rust, scale and like undesirable material from ships' hulls, storage tanks and the like.

U.S. Pat. No. 3,827,187 issued to Akira Yamamoto, et al entitled "Abrasive Apparatus" shows an apparatus for abrasively cleaning surfaces such as a ship's hull, having a carriage and supporting rollers for engaging the rail of the ship and stabilizing rollers engaging opposite sides of the rail.

U.S. Pat. No. 3,581,441 issued to Clarence Hulbert, Jr. entitled "Surface Treatment Apparatus"; U.S. Pat. No. 4,199,905 issued to Robert Neidigh entitled "Blasthead Rigging Apparatus for Tank Side Cleaning"; U.S. Pat. No. 3,566,543 issued to J. W. Fogle entitled "Machine for Treatment of Large Vertical Surfaces"; U.S. Pat. No. 3,788,010 issued to James Goff, et al entitled "Apparatus for Treatment of Vertically Disposed Surfaces"; and U.S. Pat. No. 3,872,625 issued to T. Fuma, et al entitled "Pendulous Blasting Apparatus" all show the use of an apparatus for sandblasting or other blasting the surface of a vertical structure such as the wall of a tank or the like, with the ability to be controlled remotely being seen in some instances. The above referenced patents fail to adequately solve the problem of blasting structural members such as I-beams, wide flanged beams, T-beams and like flanged members.

SUMMARY OF THE PRESENT INVENTION

The apparatus of the present invention solves problems existing in the art, by providing an apparatus for sandblasting flanged beams having a carriage which would be mountable on the flange of a beam to be sandblasted. The carriage would have mounted on it at least one drive wheel which when in contact with flanged beam would propel the carriage along the underside of the beam. Mounted on each corner of the carriage would be a leg support unit having an upper support roller for riding along the upper side of the flange of the beam, a lower support roller for engaging the lower side of the flange and lateral support rollers for engaging the outermost edges of the flange. The three rollers on each leg support enable the apparatus to move along the flange of the beam and yet secure it to the flange in a stable position. An adjustablity is provided allowing attachment to various widths of flanged beams. The apparatus would further provide a power means such as an electric motor for powering the drive wheel. An adjustable arm linkage unit for securing the nozzle of the sandblasting hose is provided, with the adjustable arm unit having the ability to both rotate axially, longitudinally and vertically so that all faces of the beam flange and the web of the beam could be sandblasted while the apparatus is in the same position on the beam to be sandblasted.

Therefore, it is an object of the present invention to provide an apparatus for sandblasting flanged beams, while being remotely controlled from the ground.

It is a further object of the present invention to provide an apparatus which could sandblast all faces of a flanged beam while suspended from one flange of the beam.

It is a further object of the present invention to provide an adjustable apparatus for sandblasting flanged beams of various widths.

It is a further object of the present invention to provide a driven apparatus for sandblasting flanged beams having frictional driving engagement with the beam to be blasted.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 5 is a view of the ball bearing pillow block assembly portion of the preferred embodiment of the apparatus of the present invention;

FIG. 7 is a perspective view of the preferred embodiment of the apparatus of the present invention secured to a vertically disposed beam, with the vertical beam in phantom lines.

DETAILED DESCRIPTION OF THE PREFERRED EMBODIMENT

Figure 1:
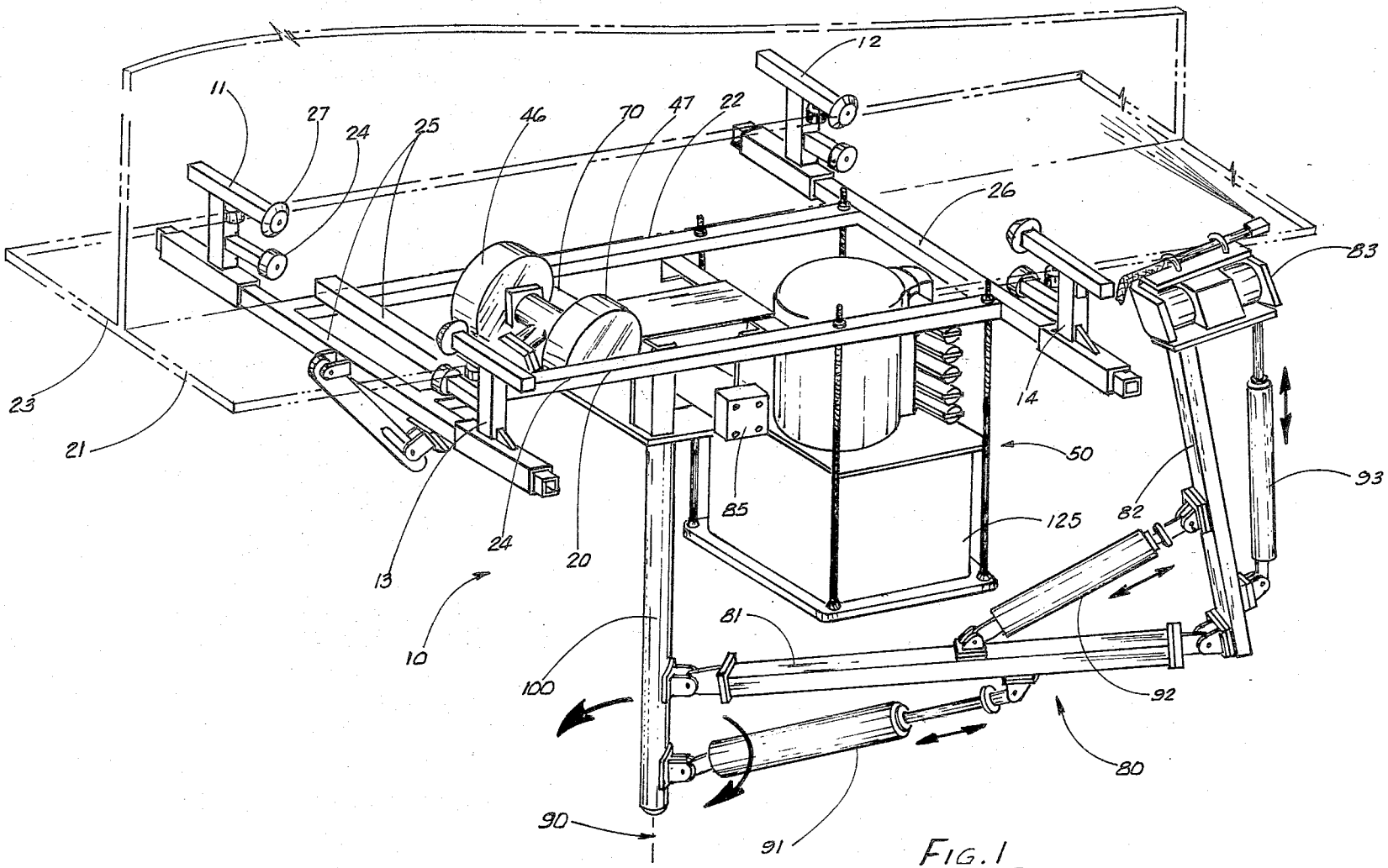
FIG. 1 is a perspective view of the preferred embodiment of the apparatus of the present invention.

Apparatus 10 is further illustrated in FIG. 1 as secured to the lower flange 21 of flange beam 23 (an I-beam, for example, being shown) by legs 11, 12, 13 and 14 of carriage 20 with the bulk of apparatus 10 preferably disposed below the lower flange 21 of beam 23 to be sandblasted. As seen in FIG. 1, the apparatus 10 would have the ability to operate on any type of a flanged beam, whether the beam be vertically or horizontally disposed.

FIG. 1 illustrates the preferred embodiment of the apparatus of the present invention generally designated by numeral 10. In its preferred embodiment, apparatus 10 would include carriage 20 supporting articulating sandblasting mechanism 80, hydraulic control package 50 and drive motor gear box assembly 70, all of which will be more clearly illustrated in subsequent figures. Carriage 20 generally comprises a pair of horizontal members 22 and 24, as seen in FIG. 1, which, when the apparatus is mounted on the flange 21, would run the length of the beam 23. Horizontal members 22 and 24 are rigidly connected to transverse members 25 and 26, as, for example, by welding. Each end of transverse members 25 and 26 would support legs 11 through 14, each leg having the ability to slide along a portion of transverse members 25 and 26 for adjusting to the various widths of flanges of the various beams to be sandblasted. Preferably, carriage 20 would be constructed from 1 inch thick structural steel square tubing.

Figure 2:
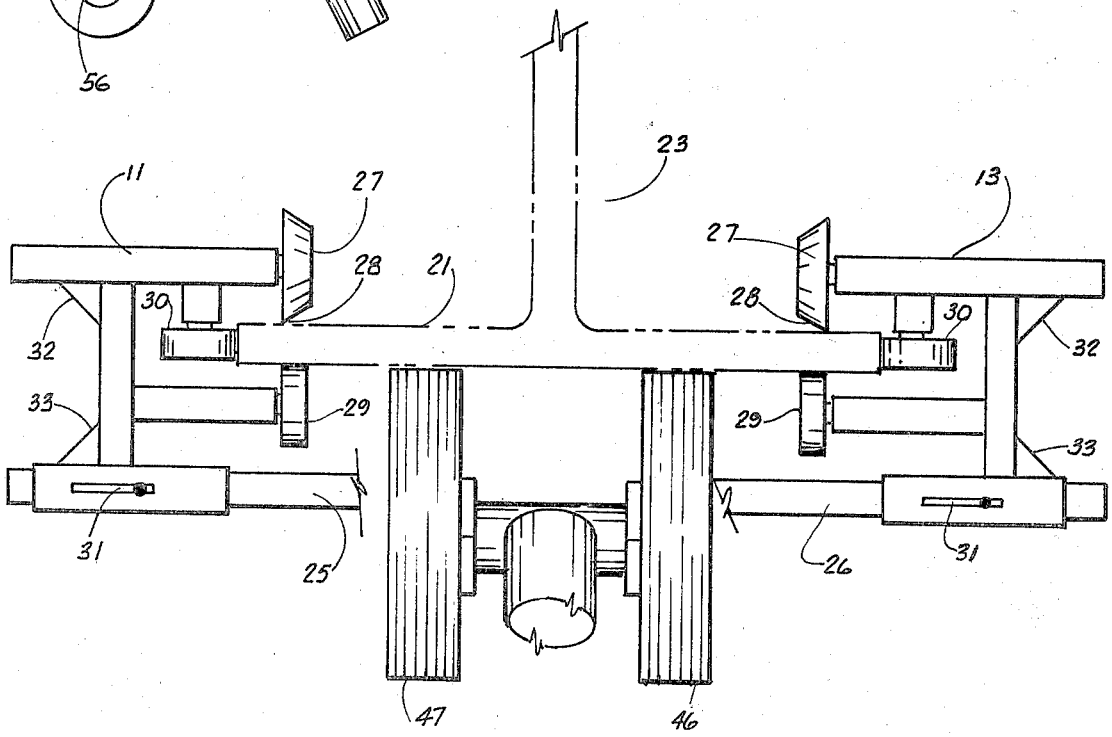
FIG. 2 is a fragmentary end view of the preferred embodiment of the apparatus of the present invention.

FIG. 2 would further illustrate the construction of two of the four legs, particularly 11 and 13. Each leg 11 or 13 would have preferably a ball bearing roller 27 for riding on the top surface of lower flange 21 of beam 23. Bevelled edge 28 of roller 27 would make contact with flange 21, so that ball bearing roller 27 would have the ability to overcome the problem of sand "plowing", as sand would accumulate on the top surface of flange 21 during the sandblasting operation. To prevent carriage 20 from moving transversely, a flat faced bearing roller 30, as seen in FIG. 2, would be making contact with each lateral most edge of flange 21. Bearing rollers 29 would be provided for making contact with the lower surface of flange 21 and ought to prevent the apparatus 10 from lifting off the flange 21 during the extention of the sandblasting mechanism 80, during the sandblasting operation. Preferably, leg means 11 through 14 would be constructed of $1\frac{1}{4}''$ square tubing welded together with a 1" square tubing and a 1" square key stock as illustrated in FIG. 2. On the 1-1" square key stock, a slot 31 preferably 2" in length with $\frac{1}{4}''$ in width would be provided so that each leg means 11 through 14 may be adjusted along transverse members 25 and 26 and bolted on carriage 20 by standard thread bolts through holes in transverse members 25 and 26. A pair of gusset plates 32 and 33 are welded at each corner of each leg means 11 through 14 in order to increase the rigidity of the entire structure of the apparatus 10. Preferably roller 27, 29 and 30 would be attached to each leg means 11 through 14 by a standard thread cap screw with bushings therein between.

Figure 3:
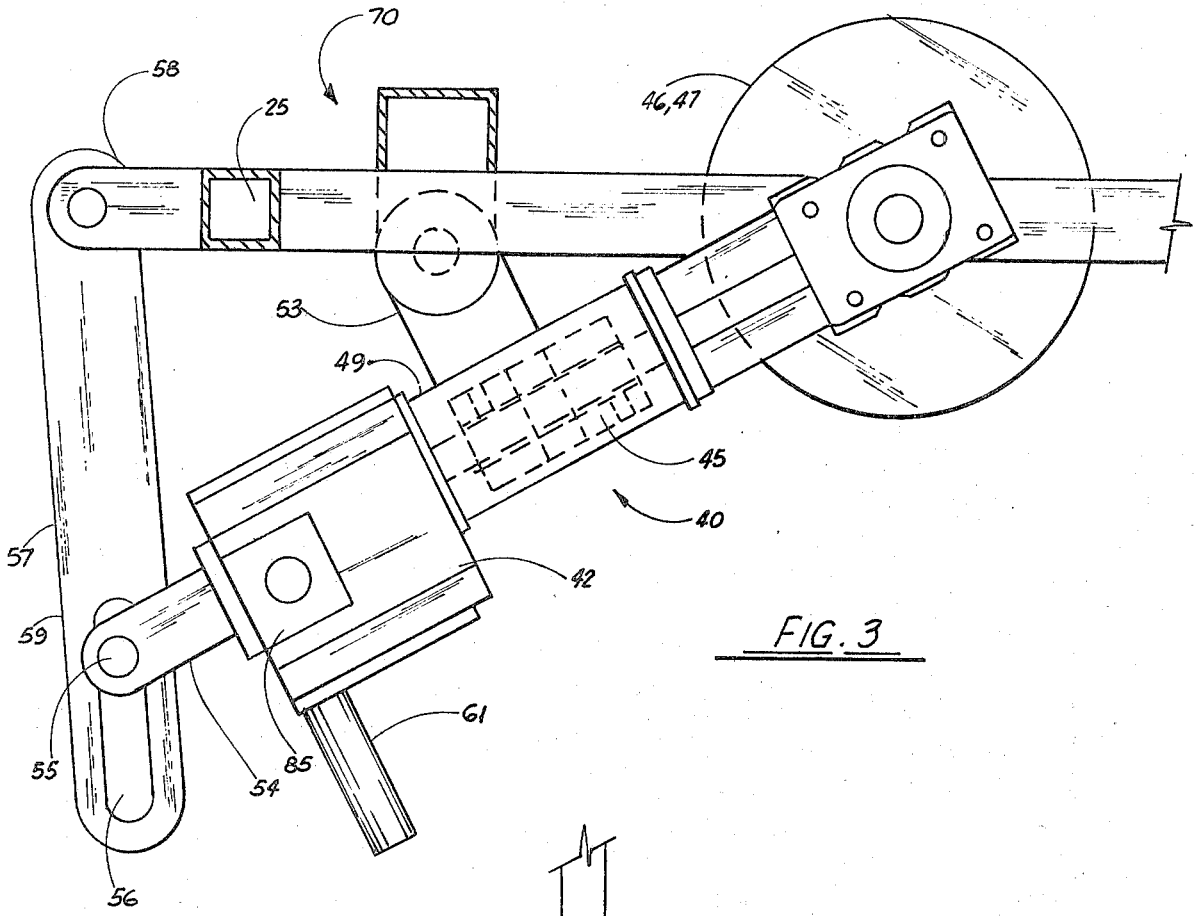
FIG. 3 is a fragmentary side view of the drive assembly portion of the preferred embodiment of the apparatus of the present invention.
Figure 4:
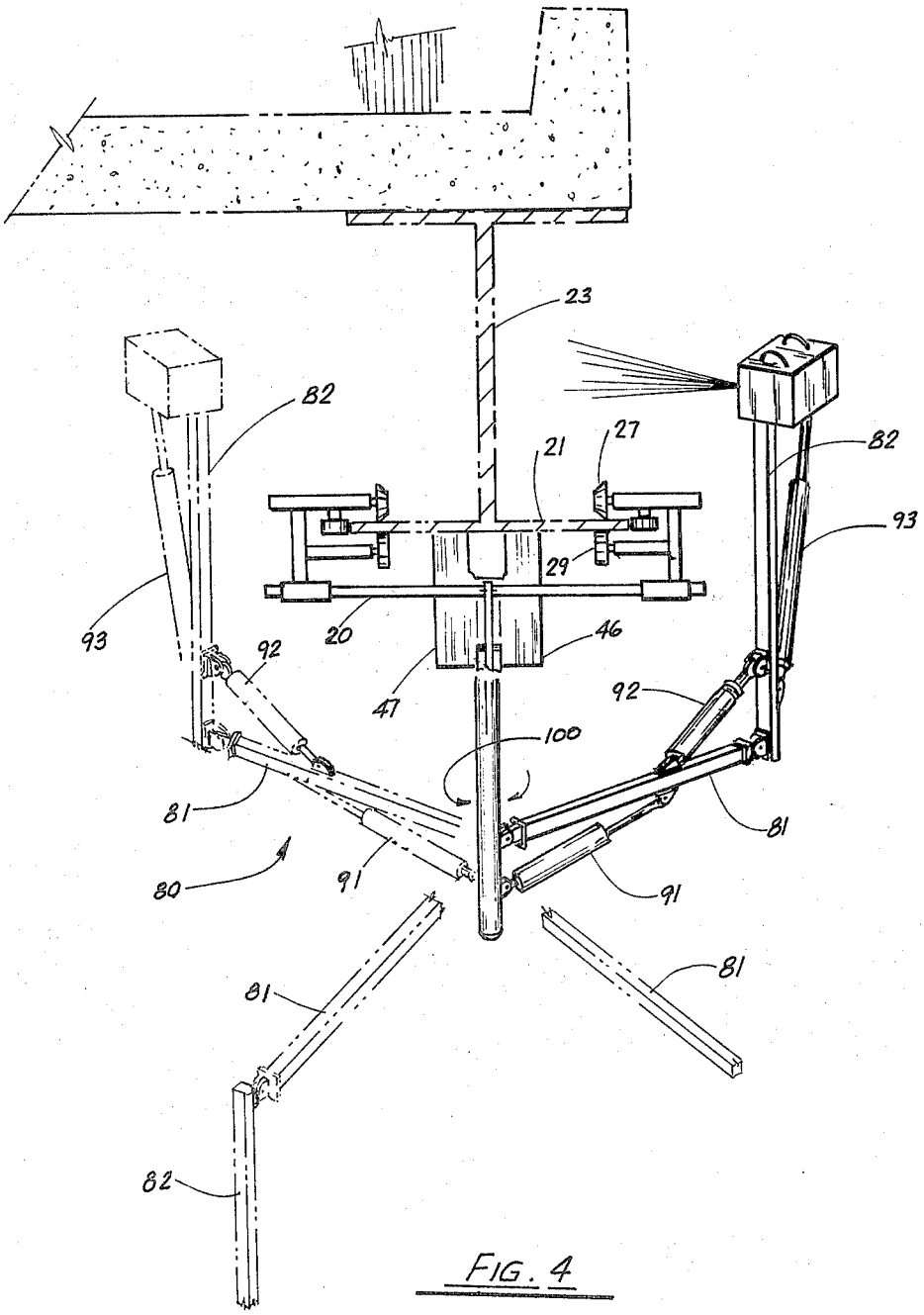
FIG. 4 is a front view of the preferred embodiment of the apparatus of the present invention illustrating the articulating arm mechanism in phantom movement.

As illustrated in FIG. 1, and more clearly illustrated in side view in FIG. 3, the drive assembly 70 which is illustrated as being mounted on transverse member 25 of carriage 20 so that carriage 20 may be propelled along the length of I-beam 23 by hydraulic means 40. Hydraulic means 40, which would be comprised of hydraulic motor 42 in the preferred embodiment would be coupled with a right angle speed reducing gear box 45 and a pair of preferably 5" diameter by 1" wide rubber treaded wheels 46 and 47. In the preferred embodiment, a minimum of 2.5 ft.-lbf would be required to overcome friction and accelerate apparatus 10 from 0 to 30' per minute in that time, hydraulic motor 42 would have to have an output speed of at least 50 rpm's. Hydraulic motor 42 would be mounted beneath carriage 20 and would be pivoted in order to provide positive locking of drive wheels 46 and 47 to the underside of flange 21 of beam 23 as illustrated in both FIGS. 1 and 4. Housing 49, preferably fabricated from round tubing and flat plates would provide a rigid connection between hydraulic motor 42 and gear box 45 as well as enclosing flexible shaft coupling (not shown) in FIG. 3. Preferably, a steel tab would be welded to housing 49 for providing a pivot point for the entire drive wheel assembly 70. Eye bracket 54 would be rigidly connected, preferably welded, to the back part of hydraulic motor 42 with pin 55 slided into slotted arm 57 and pivoted in an eye bracket 58 mounted to carriage 20. In order to compress wheels 46 and 47 against flange 21 of beam 23, hydraulic motor 42 is pulled down manually and bolt 59 is tightened on to arm 57.

FIG. 1 will also illustrate articulating sandblasting mechanism 80 in the preferred embodiment of the apparatus 10 of the present invention. Sandblasting mechanism 80 comprises a first arm 81 and a second arm 82 linked together and having the ability to be rotated at 360° angle about axis 90 as seen in FIG. 1 by hydraulic rotary actuator 85. Hydraulic rotary actuator 85 is a type of actuator well known in the art. The relative positions of arms 81 and 82 are controlled by hydraulic cylinders 91 and 92 respectively. Nozzle support means 83 would be tilted up and down by hydraulic cylinder 93. Nozzle support means 83 is rotated side to side by hydraulic actuator 85.

In the preferred embodiment of apparatus 10 sandblasting of all faces of an exposed beam 23, nozzle 87 location should be in the area of 1 foot to 3 feet from the various parts of the beam, such as the web face, faces of the upper and lower flange beam, and the diaphrams which connect perpendicular between the beams in order to obtain maximum efficiency from said nozzle support means 83. Referring still to FIGS. 1 and 3, articulating sandblasting mechanism 30, would be attached to vertical rotation shaft 100. In order to accomplish sandblasting on both faces of beam 23 with one installation of apparatus 10, nozzle positioning on 81 and 82 would be mounted on vertical rotation shaft 100 suspended from carriage 20 below beam 23. Vertical rotation shaft 100 would be rotated 360° by hydraulic rotary actuator 85 which is mounted onto carriage 20 apparatus 10. The full 360° rotation in the preferred embodiment, was selected so that arms 81 and 82 could be rotated to the opposite face of beam 23 where apparatus 10 is at the right or left extreme of the beams to be sandblasted. It should be noted that hydraulic actuator 85 would have the ability to operate in both clockwise and counter clockwise rotation. The type of hydraulic actuator 85 used in the apparatus 10 would be one which is known in the art and for having the ability to cause rotation, such as in the present apparatus, of the vertical shaft 100.

As illustrated in FIG. 5, a flange-type, ball-bearing pillow block 110 which has malleable housing 112 and grease-fitting supports 113 for supporting a vertical rotating shaft 100 and allowing for smooth rotation of shaft 100. Flange block 100 would preferably be mounted to a $\frac{1}{4}''$ steel plate having a hole drilled for vertical rotation of shaft 100. A $\frac{1}{4}''$ steel collar 116 would be welded just below the top of shaft 100 to apply the weight of the shaft 100 and mount arms 81 and 82 to the top of bearing pillow block 110. In the preferred embodiment screws or the like means would secure the bearing pillow block 110 to carriage 20. Ball bearing pillow block 110 was selected such that its radial load rating had the lowest rpm listing is greater than the cuppling force needed to oppose the bending moment of vertical rotation shaft 100, arms 81 and 82 and sandblast hoses which would be hooked to the bottom of the vertical rotation shaft 100.

To oppose the large bending moments created by arms 81 and 82 which shall be more than five feet when fully extended, in the preferred embodiment, shaft 100 is sized with a diameter and wall thickness that minimize stress in deflection. But the diameter of shaft 100 could not be so large that the dimensions of the pillow block bearing 110 supporting the shaft 100 would interfere with the clearance required by the arm cylinders 91 and 92. In the preferred embodiment, seamless mechanical steel tubing is utilized for shaft 100, in ¼" thickness and 1½" diameter cold drawn 1020 steel.

In the preferred embodiment, pillow block assembly 110 would be attached to carriage 20 by 4 sections of 1" thick 1½" angle iron 118 which would be preferably welded between the assembly plate 121 and the rotary actuated mounting plate 123 above.

Figure 6:
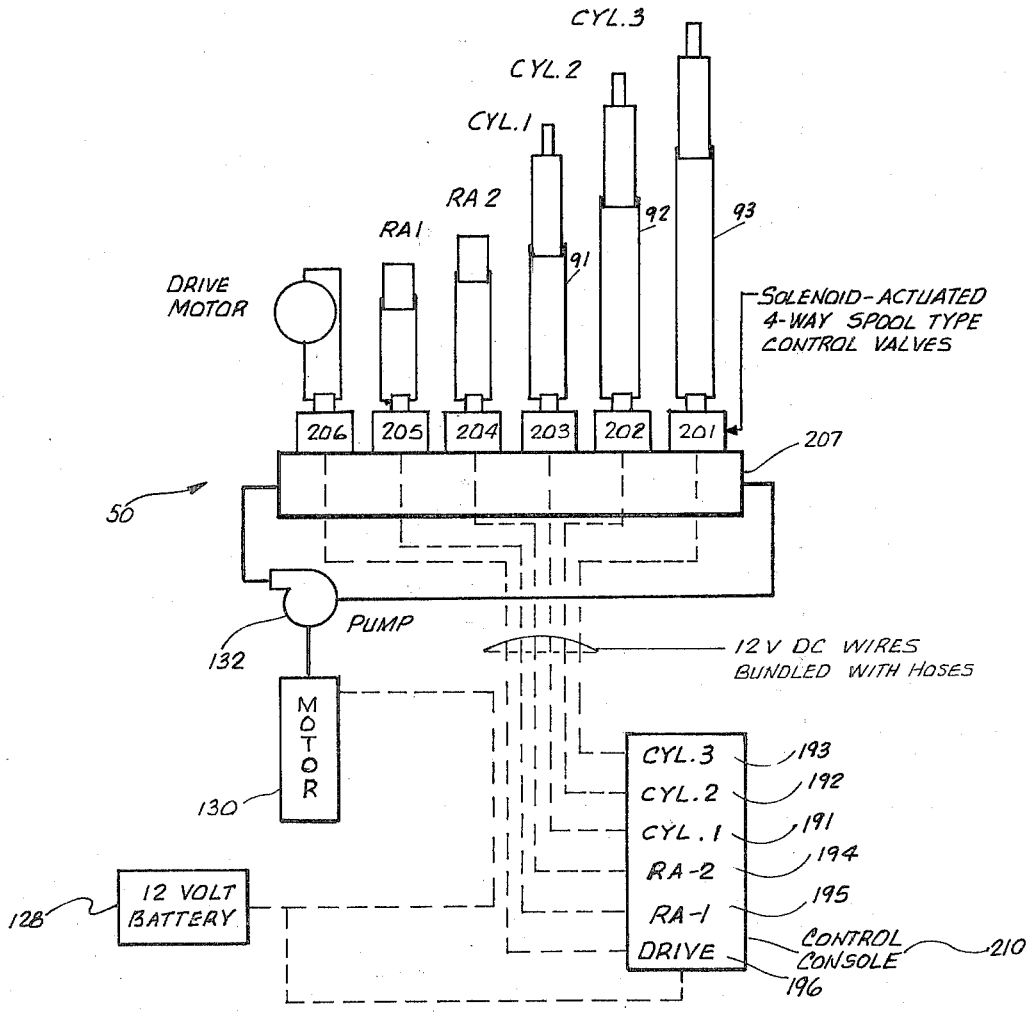
FIG. 6 is a schematic view of the control system portion of the preferred embodiment of the apparatus of the present invention.

FIG. 6 is a schematic view of factory package fluid power unit 50 utilized for powering apparatus 10. The unit would preferably consist of a 12 VDC battery 128, ¼ horsepower electric motor 130, which would be known in the art, which would drive hydraulic gear pump 132 with an output of approximately 450 PSI. The pump 132 and filter would be enclosed, preferably in 2 gallon reservoir tank 125 as 15 illustrated in FIG. 1. On the top portion of tank 125 a system of control valves 201–206 for the six system components would be stacked and connected to a common manifold 207. The system would receive power from a battery or the like power source and alternator of the sandblasting equipment which would be placed on the ground. This 12 VDC source would be applied to the control console 210 and to the electric motor 130 for the high power for the hydraulic power unit 50. The control console 210 would consist of a series of switches 191–196 which would send signals to the 6 celenoid actuated control valves 201–206 mounted on the power unit 50. Switches 191, 192 and 193 controlling the 3 hydraulic systems would preferably be of the 3 position toggle type, the position corresponding to extend/off, retract operation of cylinders 91, 92 and 93 respectively. The rotary actuated switches 194 and 195 would also be 3 position toggle switches in the preferred embodiment, for counter clockwise/or/clockwise operation. Drive control switch 196 would be a multiposition type, which is well known in the art, for allowing for several speeds of horizontal travel.

The hydraulic components of the control system would be engineered by the techniques well known in the art, as would be the electric components of the control console. For more concise detail of the apparatus and including the hydraulic control system and the powering of the unit, the preferred embodiment of the present invention is disclosed in a report by the University of Texas and Austin entitled "Redesign of the Remote Control Sandblast Machine," published Aug. 13, 1980, which is incorporated herein by reference thereto.

FIG. 7 would illustrate apparatus 10 as it is shown with the ability of travelling along the flanged portions of vertical extending beams 120. As can be seen in FIG. 7, apparatus 10 would be mounted onto vertical beam 120 as in the same manner as would be on horizontal flange beam 20 as was seen in FIG. 1. Please note the drive wheel mechanism 70 would be securely attached to the lower surface of flange 20 and so that the friction created by the rubber power wheels 46 and 47 against flange 122 would be such that it would overcome the friction of gravity, and enable apparatus 10 to be power driven up the beam 120, while sandblasting mechanism 10 allows the sandblasting of beam 120 to take place.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A remotely controlled apparatus for sandblasting flanged beams having at least a web and an attached flange, said apparatus comprising:

a. a carriage mountable on the underside of a flange of the beam to be sandblasted and having at least a pair of longitudinal members and a pair of transverse members;

b. a pair of left and a pair of right leg support means for attaching said carriage respectively to the left and right lateral edge portions of the beam flange, each of said leg support means comprising:

i. an upper support roller for riding on the upper surface of said beam flange;

ii. a lower support roller for engaging the underside surface of said beam flange;

iii. a lateral support roller for engaging the latermost edge of said beam flange and preventing lateral movement of said carriage with respect to the beam;

c. at least one powered wheel rotatably mounted on said carriage and frictionally engaging the underside of the beam flange;

d. articulated means movably attached to said carriage for varying an angle of attack of a nozzle means during sandblasting operation and permitting a 360 degree rotation of said nozzle means around the beam to be sandblasted.

2. The apparatus of claim 1, wherein the distance between each of said left and right leg support means is adjustable.

3. The apparatus of claim 1, wherein at least one upper support roller provides a beveled surface for engaging said beam flange.

4. The apparatus of claim 1, wherein said articulated means further comprises:

a. a vertical shaft axially rotatable to an angle of 360 degrees and extending downwardly from said carriage;

b. a first arm means hingedly attached to the distal end of said vertical shaft and a second arm means hingedly attached to a free end of the first arm for allowing blasting of all surfaces of the particular section of the beam to be blasted;

c. means for hydraulically rotating said vertical shaft and said arm means clockwise and counterclockwise during the sandblasting operation.

5. The apparatus of claim 1, wherein said powered wheel rotatably mounted on said carriage movably disengages from said beam when said carriage is not in operation.

6. An apparatus for sandblasting all faces of flanged beams having at least a web and an attached flange comprising:

a. a support carriage;

b. a pair of left and a pair of right leg support means for attaching said support carriage respectively to the left and right lateral edge portions of the underside of the beam flange, each of said leg support means comprising:

i. an upper bearing roller for riding on the upper surface of said beam flange, said upper bearing roller having a bevelled surface of engaging said beam flange;

ii. a lower bearing roller for engaging the lower surface of said beam flange;

iii. a lateral bearing roller for engaging a lateral most edge of said beam flange for preventing lateral movement of said carriage with respect to said beam;

c. at least one powered wheel rotatably mounted on said carriage and frictionally engaging the beam to be blasted, said powered wheel movably disengaging said beam when said apparatus is not in use;

d. articulated arm means movably attached to said carriage and rotatable around said flanged beam for blasting said beam, said means comprising:

i. a vertical shaft axially rotatable at 360 degrees clockwise and counterclockwise, said shaft extending downwardly from said carriage;

ii. a first arm hingedly attached at a first end to the distal end of said vertical shaft and a second end hingedly attached to a second arm, said second arm having a means for securing a sandblasting nozzle thereto;

iii. a plurality of hydraulically controlled cylinders attached between said first and second arm and said vertical shaft for hingedly moving said first and second arms in relation to the rotation of said vertical shaft.

7. The apparatus of claim 6, wherein said left and right pairs of leg support means are slidably movable for engaging various widths of flanged beams.

8. The apparatus of claim 6, wherein said drive wheel while frictionally engaging said beam flange enables vertical movement of said apparatus upward and downward along a vertically disposed beam.

9. A method of sandblasting all faces of flanged beams having at least a web and a lower attached flanged, said method comprising:

a. providing a carriage mountable on the underside of a flange of the beam to be sandblasted;

b. rotatably mounting at least one powered wheel on said carriage;

c. providing a pair of left and a pair of right support means on said carriage, each of said leg support means comprising:

i. an upper support roller for riding on the upper surface of said lower flange of said beam;

ii. a lower support roller for engaging the lower surface of said lower flange of said beam;

iii. a lateral support roller for engaging the lateral most edge of said flange of said beam and preventing lateral movement of said carriage with respect to the beam;

d. attaching the carriage to the underside of the beam flange, each of the leg support means engaging a section of the beam flange;

e. frictionally engaging the powered wheel against the lower surface of the beam flange;

f. remotely controlling the movement of the carriage along the beam flange during operation of the apparatus;

g. providing articulated arm means rotatable around said flanged beam and having a nozzle means hingedly attached to said articulated arm means;

h. sandblasting all surfaces of a section of the beam by rotating said articulated arm means around said section.

* * * * *